United States Patent [19]

Langenfeld et al.

[11] 4,331,471

[45] May 25, 1982

[54] METHOD AND DEVICE FOR INSTALLING AND REPLACING A GAS PERMEABLE INSERT IN THE WALL OF A VESSEL AND FOR THE INTRODUCTION OF GAS THERETHROUGH

[75] Inventors: Wilhelm Langenfeld, Düsseldorf, Fed. Rep. of Germany; Jacques Brihay, St.-Etienne, Belgium

[73] Assignee: Didier-Werke A.G., Wiesbaden, Fed. Rep. of Germany

[21] Appl. No.: 230,368

[22] Filed: Jan. 30, 1981

[30] Foreign Application Priority Data

Feb. 2, 1980 [DE] Fed. Rep. of Germany ..... 3003884

[51] Int. Cl.[3] ..... C21C 5/48; C21B 7/16

[52] U.S. Cl. ..... 75/59; 75/60; 266/217; 266/220; 266/265

[58] Field of Search ..... 75/59, 60; 266/217, 266/220, 265

[56] References Cited

U.S. PATENT DOCUMENTS 3,330,645 7/1967 DeMoustier ..... 75/60

*Primary Examiner*—P. D. Rosenberg

*Attorney, Agent, or Firm*—Wenderoth, Lind & Ponack

[57] ABSTRACT

A vessel, such as a ladle or converter has a wall having extending therethrough a bore. A tube is fixed in a gas tight manner within the bore. The tube has therethrough a cylindrical passage. At least one gas permeable insert is fitted in a gas tight manner within the passage. The insert may be a pre-shaped insert or may be a mass tamped and packed into the passage. The insert may be replaced by drilling the insert from the passage of the tube and fitting a new insert within the passage. A gas connection is connected to the outer end of the tube to supply gas into the tube and through the insert into the interior of the vessel.

54 Claims, 10 Drawing Figures

METHOD AND DEVICE FOR INSTALLING AND REPLACING A GAS PERMEABLE INSERT IN THE WALL OF A VESSEL AND FOR THE INTRODUCTION OF GAS THERETHROUGH

BACKGROUND OF THE INVENTION

The present invention relates to a method and device for installing and replacing a gas permeable insert in the wall of a vessel, particularly a vessel such as a casting or teeming label or a converter containing a melt such as a metal or glass melt, and for the introduction of a gas therethrough, for example a circulation gas or a carrier gas containing a gaseous, liquid or solid material. More particularly, the present invention is related to such a method and device wherein the gas permeable insert is fireproof or refractory and is mounted in a gas proof manner in the area of the lining of the vessel wall, and whereby when necessary the gas permeable insert may be removed from the wall and replaced by a new insert.

It is generally known in the metallurgical art to introduce a gas through the wall of a vessel into the interior of the vessel. In such known arrangements, gas is introduced through a gas permeable refractory insert. Such insert may be in the form of a conically-shaped brick fitted within a specially provided brick of the wall, such brick having therein a perforation to receive the conical insert. Alternatively, such known insert may be in the form of a cube-shaped brick or insert fitted within neighboring brick work of the vessel lining. Such known inserts are cemented in their respective openings in a gas tight manner and are inwardly contacted by the melt contained in the vessel. Gas may be supplied to the outer surfaces of such inserts to pass therethrough into the melt in the interior of the vessel (see for example Didier phamphlet No. 1675 976 30 H: "Fireproof materials for the use of circulation and carrier gases in metallurgy"). Such known gas permeable inserts are constructed to be permeable to the particular gas involved at the particular gas pressures contemplated. However, such inserts are also constructed to be non-permeable to the metal melt, such that in the event of a drop of pressure of the gas, the melts will not escape outwardly through such inserts.

However, such known systems suffer from certain inherent disadvantages. Particularly, whenever the gas permeable brick insert must be replaced, for example upon the occurrence of wear or erosion, then the gas permeable insert must be broken out of its position in the vessel lining or wall. This is a laborious and time consuming operation which must be performed after cooling down of the vessel. For this reason, in the case of vessels of the converter type, replacement of the gas permeable insert is made only when the lining of the vessel is replaced.

On the otherhand, it is known in the art to inject a gas, such as a circulation gas or carrier gas, into a metal melt through the wall of the vessel by means of a tubular lance. This arrangement however also suffers from the inherent disadvantage that, at least when the injection occurs at a level below the top of the melt, for example through the bottom of the vessel, whenever a drop in the pressure of the injected gas occurs, there exists the very serious danger that the melt will flow from the vessel through the lance.

SUMMARY OF THE INVENTION

With the above discussion in mind, it is an object of the present invention to provide a method and device for installing and replacing a gas permeable insert in the wall of a vessel and for the introduction of gas therethrough, such method and device overcoming the disadvantages of the prior art.

This object is achieved in accordance with one aspect of the present invention by the provision, in a vessel such as a ladle or a converter having a wall, and a device for allowing the introduction of a gas through the wall into the interior of the vessel, the improvement wherein the gas introduction device comprises a bore extending through the wall, a tube fixed in a gas tight manner within the bore, the tube having therethrough a cylindrical passage, and at least one gas permeable insert fitted in a gas tight manner within the passage.

The above object of the invention is achieved in accordance with a further aspect of the present invention by the provision of a method for installing and replacing a gas permeable insert in the wall of a vessel such as a ladle or a converter by providing a bore through the wall, fixing a tube having therethrough a cylindrical passage within the bore in a gas tight manner, and fitting a gas permeable insert in a gas tight manner within the passage. The insert is replaced by drilling the insert from the passage of the tube and fitting a new insert within the passage.

The object of the invention is achieved in accordance with a further aspect of the present invention by the provision of a method for introducing gas through a wall of a vessel such as a ladle or converter by providing a bore through the wall, fixing a tube having therethrough a cylindrical passage within the bore in a gas tight manner, fitting a gas permeable insert in a gas tight manner within the passage, and introducing gas into the outer end of the tube, such that the gas passes through the insert and into the interior of the vessel.

The object of the invention is achieved in accordance with a further aspect of the present invention by the provision of a device for introducing gas through the wall of a vessel such as a ladle or converter, the device including a tube adapted to be fixed in a gas tight manner within a bore through a wall of a vessel, the tube having therethrough a cylindrical passage, at least one gas permeable insert fitted in a gas tight manner within the passage, and means for introducing gas into an outer end of the tube, such that the gas passes through the insert.

BRIEF DESCRIPTION OF THE DRAWINGS

The above and other objects, features and advantages of the present invention will be apparent from the following detailed description, taken with the accompanying drawings, wherein.

DETAILED DESCRIPTION OF THE INVENTION

Figure 1:
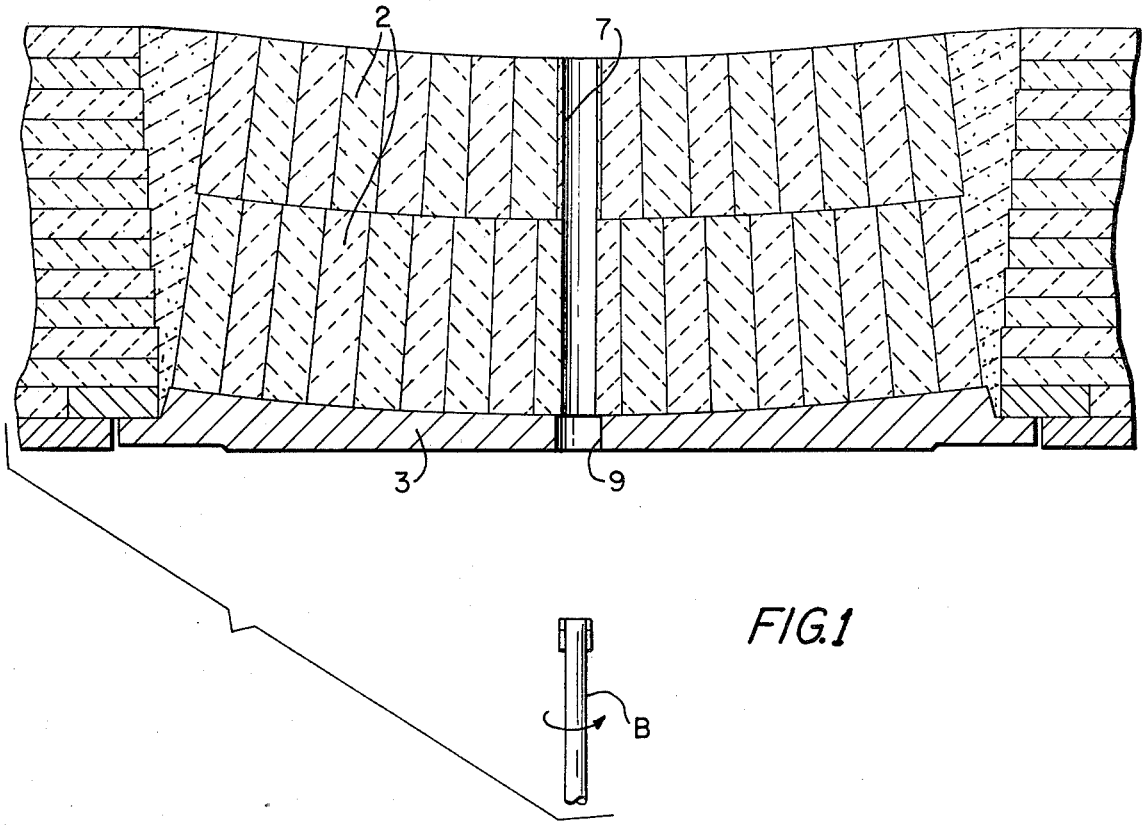
FIGS. 1 through 4 are somewhat schematic partial sections through a vessel and illustrating sequential steps for the introduction of gas permeable inserts into the wall of a vessel and for the introduction therethrough of a gas in accordance with the present invention.
Figure 2:
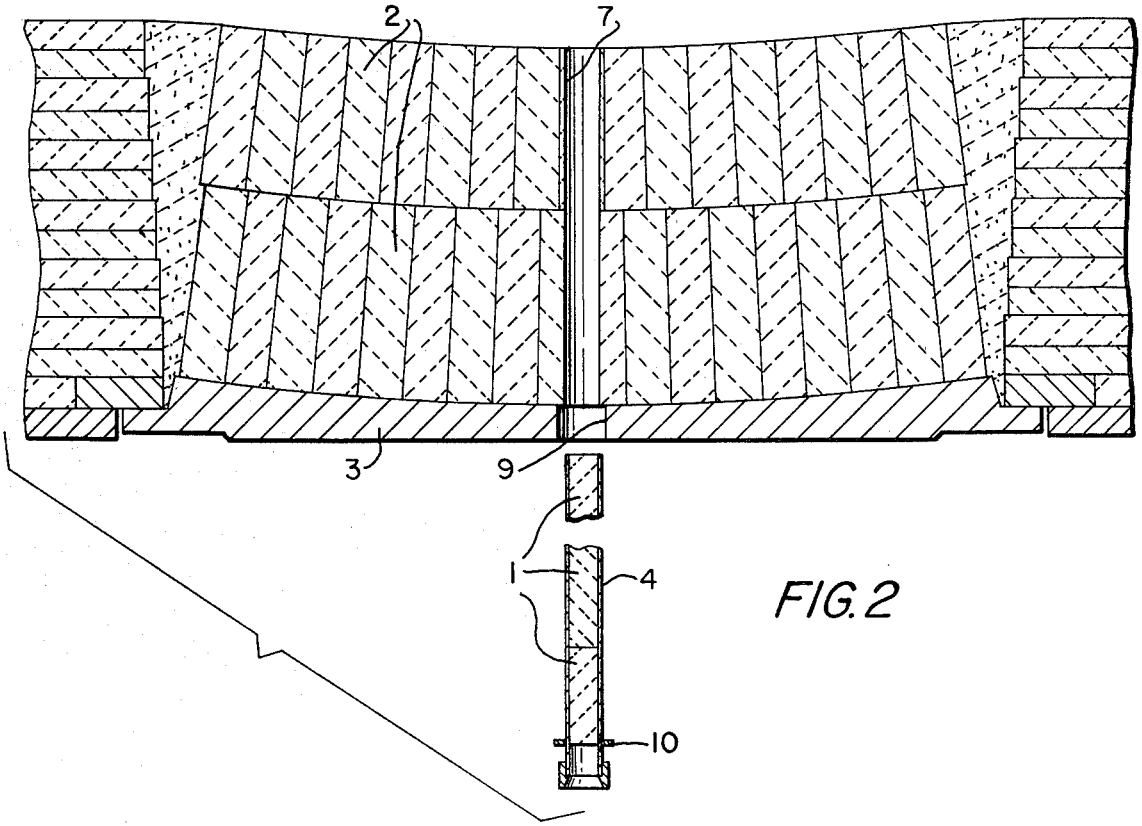
Figure 3:
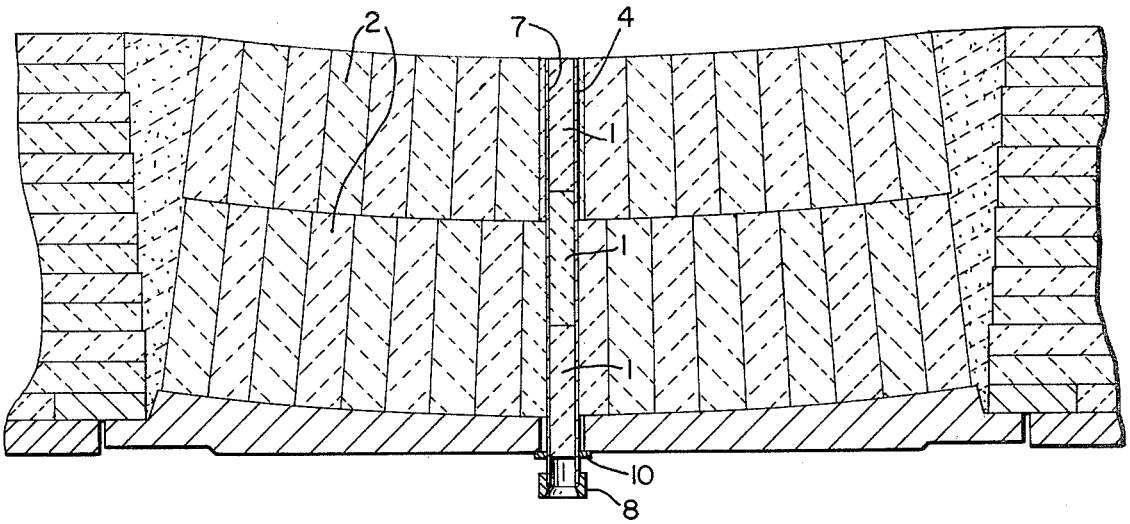

Initially, the present invention will be described with reference to FIGS. 1 through 4 which illustrate a converter bottom having a lining 2 consisting of two layers of individual bricks, the lining being arranged on a bottom metal plate 3 of the converter. It is to be understood that this specific illustration is illustrative only and is not intended to be limiting of the scope of the present invention. Thus, the concept of the present invention may be employable in any type of vessel and at other locations therein than the bottom thereof. The converter bottom plate 3 is provided therein with an opening 9, and the lining 2 is provided with a bore 7 aligned with opening 9 and extending through the wall of the vessel. The opening 9 and aligned bore 7 may be designed into the structure of the vessel during the construction thereof. That is, upon the construction of the vessel, the opening 9 and aligned bore 7 may be already provided therein. Alternatively however, the opening 9 and aligned bore 7 may be formed, for example by drilling by means of drill B (FIG. 1) in an existing vessel. This latter arrangement is preferred and has the advantages that the exact location of the point at which the gas will be introduced into the vessel may be determined by subsequent need, and additionally the direction of the bore 7 may be precisely controlled. A tube 4 having therethrough a cylindrical passage, such as a cylindrical tube, is inserted into the bore 7 and is cemented therein in a gas tight manner. The tube 4 may be a metal tube or a ceramic tube. FIG. 2 illustrates the tube prior to insertion into bore 7, and FIG. 3 illustrates the tube 4 after insertion into bore 7. The outer end of tube 4 may preferably be provided with a flange 10 to abut against the outer surface of bottom metal plate 3 and to thereby axially position the tube 4 within bore 7.

One or a plurality of gas permeable fire-proof or refractory inserts 1 are fitted in a gas tight manner within the passage of tube 4.

Figure 7:
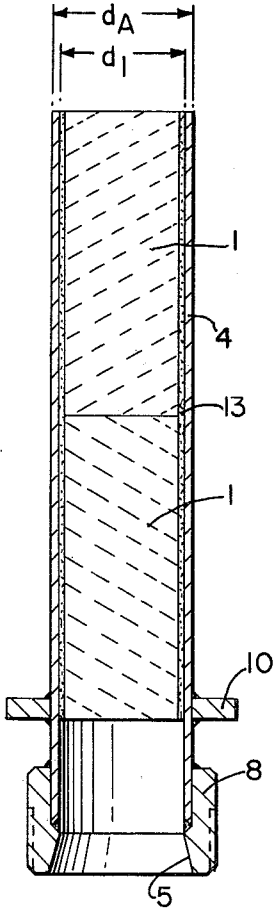
Figure 6:
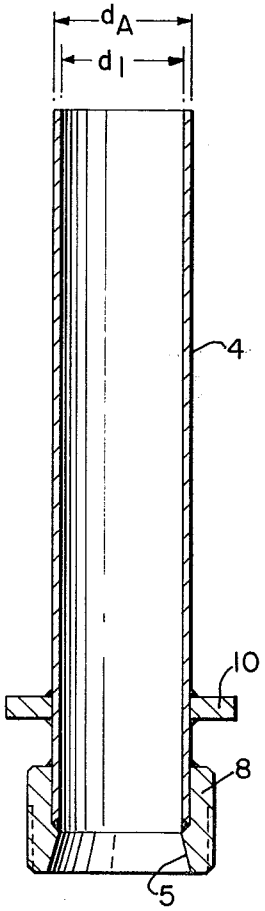
Figure 5:
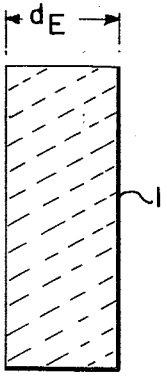

The outer end of the tube 4 has attached thereto, for example by welding, an extension 8. The outer end of the tube, or the extension 8 as illustrated in the drawings, has a widened and flaired entrance opening. Thus, as will be readily apparent from a consideration of FIGS. 3 and 7, when it is desired to replace a given insert or inserts 1 within the tube 4, this may be done by simply drilling out the insert or inserts from the interior passage of the tube 4. The widened opening 5 facilitates introduction of the drill. After an old insert or inserts are drilled out from the interior passage from the tube 4, a new insert or inserts may be fitted within the interior passage of the tube. The tube need not be removed from the wall of the vessel. Thus, it will be apparent that in accordance with the present invention, the gas permeable insert or inserts may be easily and quickly replaced during a relatively brief stop in operation of the vessel. The insert or inserts may be replaced without removing the entire structure from the wall of the vessel. This is a distinct improvement over prior art arrangements wherein gas permeable inserts had to broken out of the vessel wall by a laborious and time consuming operation.

Figure 4:
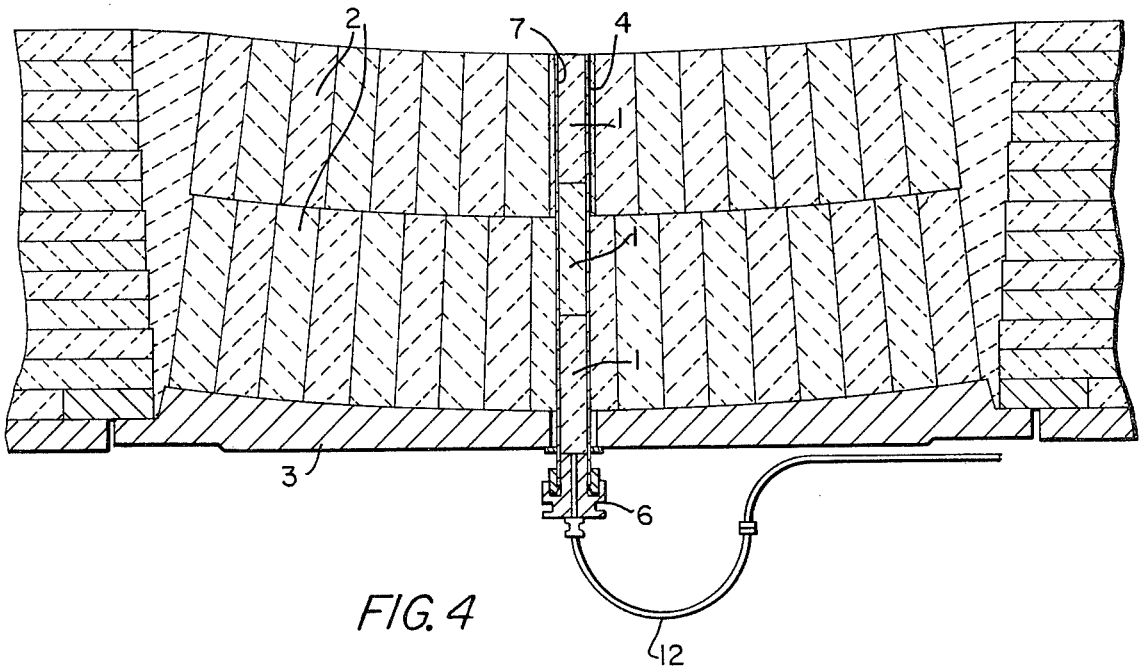
Figure 8:
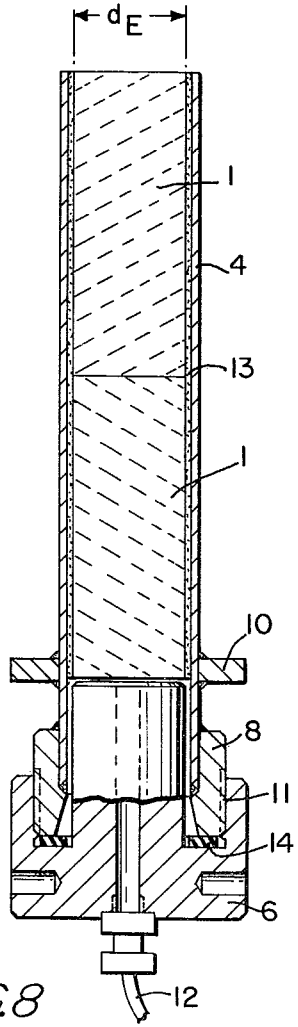
FIGS. 5 through 8 are enlarged sections illustrating the device of the present invention.

As shown in FIGS. 4 and 8 of the drawings, a gas supply connection 6 may be connected to the outer end of the tube, and specifically in the illustrated embodiments to the outer surface of the extension 8, for example by means of complementary threads 11. Gas supply line 12 is connected to connection 6 in a conventional manner, and a seal or gasket 14 is also provided to maintain a gas tight arrangement. Thus, gas is supplied through line 12 and connection 6 into the interior of tube 4, and the gas then passes through the insert or inserts 1 into the interior of the vessel.

The tube 4 may be a metal tube or ceramic tube. The particular metal or ceramic material of the tube 4 is not critical as long as such material is resistant to the environment within the interior of the vessel. It has been found that tubes formed of copper, steel such as ST 35, as well as other high alloy materials may be employed for tube 4. It has also been found that tube 4 may be in the form of a ceramic tube with a base of zirconium oxide, highly aluminous and/or magnesite raw materials. It is believed that the specific materials which may be employed for tube 4 will be apparent to those skilled in the art upon considering the present disclosure.

The tube 4 may be cemented within bore 7 by means of known refractory cements, for example cements containing corundum. The particular cement employed is not critical and may be a conventional cement which will be resistant to the environment within the interior of the vessel.

In the arrangements of FIGS. 1–4, the inserts extend through the bottom of the converter wall, and the inserts must be fire-proof and refractory to resist the melt within the interior of the vessel. The inserts must also be impermeable to the particular melt employed, such that upon a drop of pressure of the gas to be injected, the melt will not be able to escape through the inserts.

Figure 9:
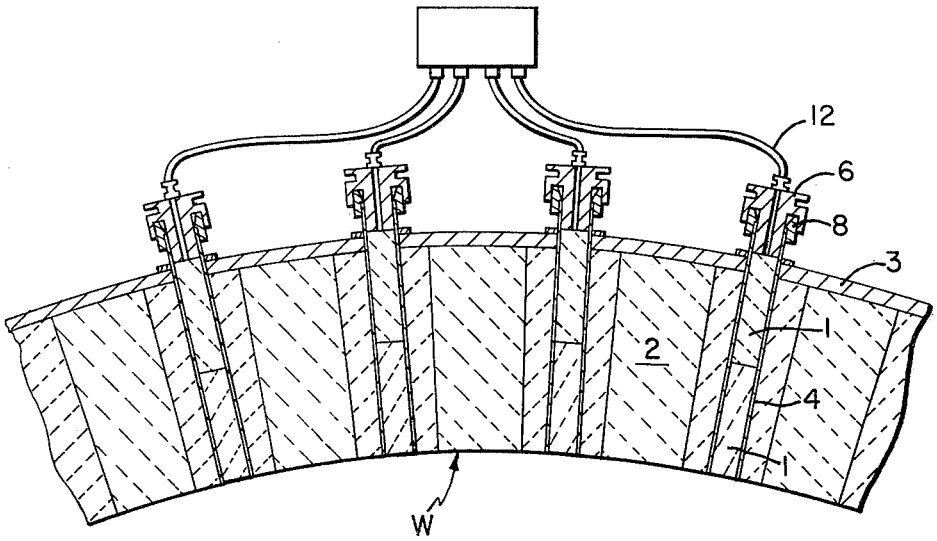
FIGS. 9 and 10 are a cross-section and a partial perspective view, respectively, of an arrangement in accordance with the present invention wherein a gas may be introduced through several positions in the wall of a vessel for purposes of cooling or blanketing.
Figure 10:
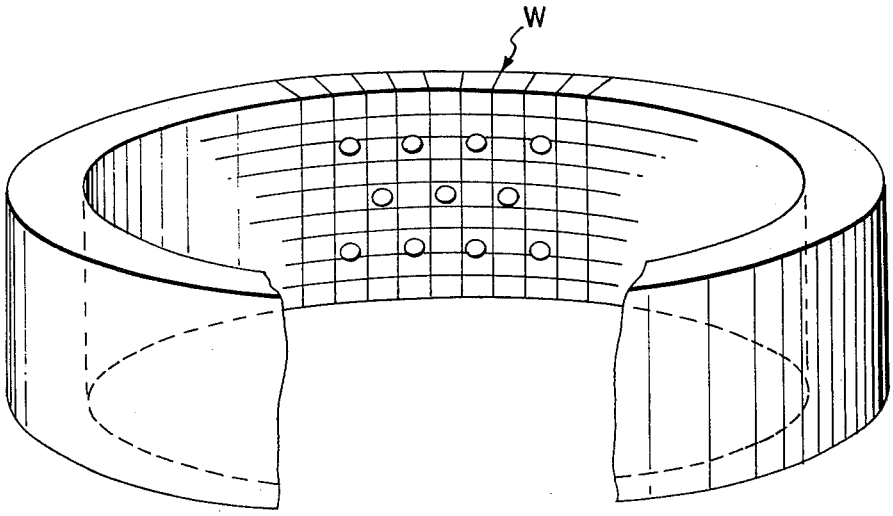

The concept of the present invention illustrated in FIGS. 1–4 is particularly useful for the treatment of melts, for example metal or glass melts. However, the concept of the present invention is also employable in systems wherein the gas is not introduced directly into the melt within the vessel. Thus, the concept of the present invention may be employed in an area above the melt, for example for the purpose of cooling wall areas of a vessel or to provide an atmosphere of blanketing gas within the interior of the vessel. Such an arrangement may include a single tube having therein an insert or inserts. However, such an arrangement may also include a plurality of tubes containing inserts, since the cross-sectional size of each arrangement is relatively small and will not weaken the wall of the vessel. Such a situation is illustrated in FIGS. 9 and 10, wherein a wall area W of a vessel, for example an electric furnace, has therethrough a plurality of the type of devices illustrated in FIG. 8. Thus, the plurality of devices may extend through wall area W at an upper portion of the vessel for the introduction of a cooling gas or a blanketing gas.

In the arrangement illustrated in the drawings, each insert 1 is the form of a pre-shaped insert or brick inserted into and cemented within the passage of tube 4 by means of cement 13. Cement 13 may be a conventional refractory cement, as will be apparent to those skilled in the art. The tube 4 has an outer diameter dA and an inner diameter dI. The pre-shaped insert 1 has an outer diameter dE which is only slightly less than the inner diameter dI of tube 4.

Alternatively however, the insert 1 may comprise a mass of refractory material which is packed into the passage of tube 4 in a gas tight manner. Additionally, it will be apparent that the tube 4 may be provided with a combination of a pre-shaped insert 1 and one or more insert layers formed by packing a mass of refractory material.

It will be apparent that the particular gas permeable refractory insert or inserts 1 for a given installation and operation will have characteristics based upon the particular melt in the vessel involved, the particular gas to be injected into the melt, and the pressure of the particular injected gas. Also, the gas may be a carrier gas employed to carry an additional material into the melt for treatment of the melt. Such additional material may be in the form of a gas, a liquid or a solid, and the construction of the particular insert involved will be influenced by the particular type of any such additional material to be introduced into the melt by the carrier gas.

The material of the insert 1 may be known refractory materials employed for conventional gas permeable inserts. The particular material, as indicated above, must be adapted to the specific environment intended. The refractory material employed for insert 1 may be a granular substance having the following principle compositions and characteristics:

| Raw material base | AL203 | MGO | ZRS104 | Total Porosity | Permeability to gas |
|---|---|---|---|---|---|
| Sintered mullite | 70 | — | — | Ca.25-28 | Ca.150-400 |
| Zirconium silicate | — | — | 100 | Ca.28 | Ca.150 |
| Fireproof clay | 40 | — | — | Ca.25 | Ca.70 |
| Melting corundum | 99 | — | — | Ca.20 | Ca.10 |
| Bauxite | 75-80 | — | — | Ca.22 | Ca.10 |
| Magnesite | — | 95 | — | Ca.28-30 | Ca.150-400 |

The determination of the permeability to gas is made in accordance with DIN No. 51058, and the dimensions employed are NANOPERM (1 NPM$=10^{-9}$ PERM).

Also, the insert 1, particularly for use in the embodiment of FIGS. 9 and 10, may be a fibrous material, for example a material of hydrous alumina silicate or aluminum oxide up to 99%.

The insert 1 may be a porous material or a material interspersed with longitudinal channels. Such longitudinal channels are of particular advantage when the gas to be injected is a carrier gas carrying particles of a solid or liquid additional material to be introduced into the melt, since such particles would otherwise tend to lead to blockage of a porous material. The size of such longitudinal channels must, as will be apparent, be sufficient to allow passage of the carrier gas and additional material without blockage of the insert, but maintain the insert impermeable to the melt. Experience has shown that the diameter of such longitudinal channels should be from 0.5 to 0.9 mm. However, it is not intended that this specific size be limiting to the present invention.

Again, the porosity of the insert must be such as to enable passage therethrough of the gas to be injected, as well as possible additional solid or liquid particles, but maintain the insert impermeable to the particular melt employed upon a pressure loss in the gas.

It will be apparent that a unique feature of the present invention is that the tube 4 is employed as a pipe for introducing gas into the gas permeable insert, and is also used as a guide for a drill to drill out an old insert in a rapid and easy manner, whereafter a new insert may be fixed within the tube. It will further be apparent that in accordance with the present invention it is possible, employing predetermined heights of essentially cylindrical gas permeable inserts, to bridge vessel walls of differing thickness, and also to adjust the gas permeability of an assembly of insert or inserts to a particularly desired extent.

Also the present invention has been described and illustrated with respect to specifically preferred features thereof, it is to be understood that various modifications and alterations may be made without departing from the scope of the present invention. Thus, the materials of the tube 4, the inserts 1 and the various cements may be other than those specifically described, as long as capable of achieving the above-discussed functions. Also, the gas supply connection 7 could be connected directly to the outer end of the tube 4, rather than to extension 8 as illustrated.

We claim:

1. In a vessel, having a wall, and means for allowing the introduction of a gas through said wall into the interior of said vessel, the improvement wherein said means comprises:

a bore extending through said wall;

a tube fixed in a gas tight manner within said bore, said tube having therethrough a cylindrical passage; and at least one gas permeable insert fitted in a gas tight manner within said passage.

2. The improvement claimed in claim 1, wherein said vessel is adapted to contain therein a melt at a level above said bore, and said insert is impermeable to said melt.

3. The improvement claimed in claim 1, wherein said tube comprises a metal tube.

4. The improvement claimed in claim 1, wherein said tube comprises a ceramic tube.

5. The improvement claimed in claim 1, wherein said insert is formed of a refractory material.

6. The improvement claimed in claim 1, wherein said insert is formed of a porous material.

7. The improvement claimed in claim 1, wherein said insert if formed of a material interspersed with longitudinal channels.

8. The improvement claimed in claim 1, wherein said insert comprises a pre-shaped insert inserted into and cemented within said passage.

9. The improvement claimed in claim 1, wherein said insert comprises a mass packed into said passage.

10. The improvement claimed in claim 1, wherein said insert is formed of a granular substance.

11. The improvement claimed in claim 1, wherein said insert is formed of a fibrous material.

12. The improvement claimed in claim 1, wherein the outer end of said passage in said tube has an outwardly flared and widened entrance opening.

13. The improvement claimed in claim 1, further comprising a gas supply connection connectable to the outer end of said tube.

14. The improvement claimed in claim 1, further comprising an extension connected to the outer end of said tube.

15. The improvement claimed in claim 14, wherein said extension is fixed to the outer surface of said tube.

16. The improvement claimed in claim 14, wherein said extension has an opening flaring inwardly to said outer end of said tube.

17. The improvement claimed in claim 14, further comprising a gas supply connection connectable to said extension for introducing gas into said tube and through said insert into the interior of said vessel.

18. The improvement claimed in claim 1, comprising an arrangement of a plurality of said means extending through said wall.

19. The improvement claimed in claim 1, wherein said vessel is adapted to contain therein a melt at a level below said bore, such that said insert is not placed in direct contact with said melt.

20. The improvement claimed in claim 19, comprising an arrangement of a plurality of means extending through said wall at a level above said melt, for introducing a cooling or blanketing gas into the interior of said vessel above said melt.

21. A method of installing a gas permeable insert in the wall of a vessel, such that a gas may be introduced through the insert into the interior of the vessel, said method comprising:

providing a bore through said wall;

fixing a tube having therethrough a cylindrical passage within said bore in a gas tight manner; and fitting a gas permeable insert in a gas tight manner within said passage.

22. A method as claimed in claim 21, further comprising replacing said insert by drilling said insert from said passage, and fitting a new insert within said passage.

23. A method as claimed in claim 21, wherein said providing comprises forming said bore in said wall of said vessel at a predetermined location therein during the construction of said vessel for the insertion of said tube at a subsequent time.

24. A method as claimed in claim 21, wherein said providing comprises drilling said bore in said wall, after the construction thereof, and at a specifically preferred location.

25. A method as claimed in claim 21, comprising cementing said tube in said bore.

26. A method as claimed in claim 21, wherein said fitting comprises forming a pre-shaped insert, and cementing said insert within said passage.

27. A method as claimed in claim 21, wherein said fitting comprises packing a mass of insert material within said passage.

28. A method as claimed in claim 21, further comprising connecting a gas supply connection to the outer end of said tube.

29. A method for introducing gas through the wall of a vessel, and into the interior of said vessel, said method comprising:

providing a bore through said wall;

fixing a tube having therethrough a cylindrical passage within said bore in a gas tight manner;

fitting a gas permeable insert in a gas tight manner within said passage; and introducing gas into the outer end of said tube, such that said gas passes through said insert and into the interior of said vessel.

30. A method as claimed in claim 29, further comprising connecting a gas supply connection to said outer end of said tube, and supplying said gas from said connection into said tube.

31. A method as claimed in claim 29, wherein said vessel contains therein a melt at a level above said bore, and said gas comprises a circulation gas or a carrier gas which is introduced into said melt.

32. A method as claimed in claim 29, wherein said vessel contains therein a melt at a level below said bore, such that said insert is not placed in direct contact with said melt, and said gas comprises a cooling gas or a blanketing gas which is introduced into the interior of said vessel above said melt.

33. A method as claimed in claim 32, comprising introducing said gas through a plurality of inserts fitted within a plurality of tubes fixed within a plurality of bores.

34. A method as claimed in claim 29, further comprising replacing said insert by drilling said insert from said passage, and fitting a new insert within said passage.

35. A method as claimed in claim 29, wherein said providing comprises forming said bore in said wall of said vessel at a predetermined location therein during the construction of said vessel for the insertion of said tube at a subsequent time.

36. A method as claimed in claim 29, wherein said providing comprises drilling said bore in said wall, after the construction thereof, and at a specifically preferred location.

37. A method as claimed in claim 29, comprising cementing said tube in said bore.

38. A method as claimed in claim 29, wherein said fitting comprises forming a pre-shaped insert, and cementing said insert within said passage.

39. A method as claimed in claim 29, wherein said fitting comprises packing a mass of insert material within said passage.

40. A device for introducing a gas through the wall of a vessel, said device comprising:

a tube adapted to be fixed in a gas tight manner within a bore through a wall of a vessel, said tube having therethrough a cylindrical passage;

at least one gas permeable insert fitted in a gas tight manner within said passage; and means for introducing gas into an outer end of said tube, such that said gas passes through said insert.

41. A device as claimed in claim 40, wherein said tube comprises a metal tube.

42. A device as claimed in claim 40, wherein said tube comprises a ceramic tube.

43. A device as claimed in claim 40, wherein said insert is formed of a refractory material.

44. A device as claimed in claim 40, wherein said insert is formed of a porous material.

45. A device as claimed in claim 40, wherein said insert is formed of a material interspersed with longitudinal channels.

46. A device as claimed in claim 40, wherein said insert comprises a pre-shaped insert inserted into and cemented within said passage.

47. A device as claimed in claim 40, wherein said insert comprises a mass packed into said passage.

48. A device as claimed in claim 40, wherein said insert is formed of a granular substance.

49. A device as claimed in claim 40, wherein said insert is formed of a fibrous material.

50. A device as claimed in claim 40, wherein said outer end of said tube has an outwardly flared and widened entrance opening.

51. A device as claimed in claim 40, further comprising an extension connected to said outer end of said tube.

52. A device as claimed in claim 51, wherein said extension is fixed to the outer surface of said tube.

53. A device as claimed in claim 51, wherein said extension has an opening flared inwardly to said outer end of said tube.

54. A device as claimed in claim 51, wherein said introducing means comprises a gas supply connection connected to said extension.

* * * * *